United States Patent [19]

Gimpera

[11] Patent Number: 4,991,754

[45] Date of Patent: Feb. 12, 1991

[54] CLOSING MEMBER FOR A SLIDE GATE NOZZLE ON A VESSEL CONTAINING METAL MELT AND A SLIDE GATE NOZZLE WITH SUCH A CLOSING MEMBER

[75] Inventor: José Gimpera, Wiesbaden, Fed. Rep. of Germany

[73] Assignee: Didier-Werke AG, Wiesbaden, Fed. Rep. of Germany

[21] Appl. No.: 294,626

[22] PCT Filed: Jul. 16, 1988

[86] PCT No.: PCT/EP88/00644

§ 371 Date: Dec. 6, 1988

§ 102(e) Date: Dec. 6, 1988

[87] PCT Pub. No.: WO89/01373

PCT Pub. Date: Feb. 23, 1989

[30] Foreign Application Priority Data

Aug. 7, 1987 [DE] Fed. Rep. of Germany ..... 3726312

[51] Int. Cl.[5] ..... B22D 41/08

[52] U.S. Cl. ..... 222/600

[58] Field of Search ..... 222/590, 591, 597, 600; 216/236; 52/606, 607

[56] References Cited

U.S. PATENT DOCUMENTS 134,374 12/1872 Frank ..... 52/606
4,702,460 10/1987 Muschner ..... 222/600
4,729,497 3/1988 Fricker ..... 222/600
4,801,055 1/1989 Muschner ..... 222/600

FOREIGN PATENT DOCUMENTS 61-38774 7/1986 Japan .
2008729 10/1978 United Kingdom .

OTHER PUBLICATIONS

H-W Handbook of Refractory Practice, p. 48, 12-1980.

*Primary Examiner*—S. Kastler
*Attorney, Agent, or Firm*—Wenderoth, Lind & Ponack

[57] ABSTRACT

The invention relates to a closing member, for use in a slide gate for a molten metal container. The closing member can be formed as a ceramic block having flow channels formed therethrough and opening through different external surfaces thereof such that each flow channel has its own working surface and can be brought into operative position by rotating and/or sliding the closing member relative to the molten metal container. Alternatively, the closing member can be formed as a metal cage having recesses formed therethrough in which refractory plates can be inserted. The refractory plates each have an opening therethrough which aligns with a refractory sleeve extending through the cage. Each refractory sleeve, together with the opening through the corresponding refractory plate, forms a flow channel. Again, the different flow channels are arranged so that they can be brought into operative position by rotating and/or sliding the closing member relative to the molten metal container.

22 Claims, 4 Drawing Sheets

CLOSING MEMBER FOR A SLIDE GATE NOZZLE ON A VESSEL CONTAINING METAL MELT AND A SLIDE GATE NOZZLE WITH SUCH A CLOSING MEMBER

BACKGROUND OF THE INVENTION

The invention relates to a closing member, and particularly to a closing member of a slide gate for a molten metal container, the closing member having at least one flow channel and being mounted for interchangeability or by way of an adjustable carrier frame.

Slide gate closing members are usually plate-shaped and have one flow channel each, and when the plate-shaped closing member is in an open position, its flow channel aligns with a flow channel of a bottom plate fastened fixedly to the bottom of the molten metal container. The upper inlet edge of the closing member flow channel wears relatively rapidly due to the thermal, erosive, and corrosive effect of the molten metal stream, especially when the closing member is moved between a control and/or a closing position and a flow position. Therefore, the entire closing member has to be replaced after a few pourings. It has already been proposed that the closing member be used bilaterally, i.e. that the working surface of the closing member that is turned upward and is worn be turned downward, so that the same flow channel is used a second time with a non-eroded working surface turned upward. However, this provides only a limited advantage with respect to the service life of the closing member because the flow channel may have also become worn at other than the upper control and closing edge of the flow channel due to the molten metal passing through the flow channel. The same also applies to the bottom plate even though the opening therein does not become eroded as quickly as that of the closing member because the latter provides the control and closing functions.

Also known is a so-called rotary slide valve which has a plate-shaped closing member with openings formed therein forming multiple (e.g. three) parallel flow channels, some of which also have different cross-sections, which open through the upper working surface and the bottom surface of the rotary closing member. The flow channels can be selectively brought into operative position by rotating the closing member about an axis perpendicular thereto. Such a closing member, however, is, by necessity, relatively large since sufficiently large closing regions must be disposed between the individual flow channels.

Also known is a sector-shaped closing member plate. Such a closing member plate is mounted to swivel about a swivel axis and has two parallel flow channels which open through the upper working surface and the bottom surface of the closing member plate. The requisite closing surface regions are, with respect to the swivel axis, spaced inwardly from the flow channels. Thus, such a closing member plate must also be relatively large. Also, it is necessary to have both a drive for swivelling the closing member plate and for causing linear motion of the closing member plate.

SUMMARY OF THE INVENTION

Therefore, the object of the present invention is to design a closing member in such a manner that it has a longer reliable service life than the prior art closing members, yet retains relatively small dimensions.

This object can be achieved by the present invention by having the closing member penetrated by at least two flow channels, whose openings are preferably formed in different planes defined by different external working surfaces of the closing member. Thus, each flow channel has its own external working surface. The flow channels do not run parallel as in the prior art and, therefore, do not empty through the same external working surface. Rather each flow channel has at least one, but preferably two, of its own working surfaces. Thus, the flow channels are formed at an angle with respect to one another and each flow channel has its openings on each of two opposing external surfaces of the closing member, whereby at least one of the external surface forms a working surface of the closing member. Even though the closing member of the invention can assume both the functions of a conventional slidable or movable plate closing member and those of a conventional bottom plate, its primary purpose is for use as a slidable or movable plate closing member of a slide gate, since, as already stated above, the wear of a slidable or movable plate closing member is significantly greater than that of a bottom plate. The invention is designed more for use as a closing member in a slide valve than as a member defining a fixed-position flow path in the bottom region of a molten metal container.

After at least one external working surface and the edge of the associated flow channel have become worn, the closing member can be rotated or turned in such a manner that a new flow channel with its own non-eroded working surface is put into use. It is also possible to use the external surfaces through which both ends of a flow channel open as working surfaces of the closing member so that each flow channel can be used in two directions. It is also possible to design each flow channel differently so that, depending on the desired casting conditions, a narrower or wider flow channel can be selected.

Thus, a closing member according to the present invention, which has essentially equal height and width dimensions can have at least twice as many flow channels than the prior art closing plates, and each flow channel will have its own working surface or surfaces. Correspondingly, the service life of such a closing member can be significantly increased without having to significantly increase its size.

Preferably, the two openings of each flow channel are through mutually parallel external surfaces, in particular working surfaces, so that by simply changing the position of the closing member relative to a remainder of the slide gate, a second one of the flow channels can be brought to the position which a first one of the flow channels had previously occupied without having to change the construction.

In different embodiments of the invention, the closing member may have a substantially prismatic shape with, for example, an essentially square cross-section, or a substantially cylindrical shape. If the closing member is formed with a square cross-section, it will generally have two flow channels formed therethrough, but may have additional flow channels by having more than one flow channel per working surface. If the closing member is formed with a hexagonal cross-section it will generally have three flow channels formed therethrough, but may have additional flow channels by having more than one flow channel per working surface.

Another feature of the invention is that flow channels are arranged in the closing member in such a manner than one flow channel can be brought to the position previously occupied by another flow channel be merely turning or rotating the closing member in its carrier frame. This assures that no other changes have to be made to the slide gate with respect to its position or arrangement, since a new flow channel with its own non-eroded working surface can be positioned precisely at the position previously occupied by the worn flow channel.

In particular, the invention also contemplates that the surfaces, through which the flow channels open, be designed essentially rectangular with rounded or bevelled corners between adjacent external surfaces and that the end surfaces have an essentially square, hexagonal or round shape. As well known, the essentially rectangular design of a working surface serves the purpose of providing, by means of its off-center arrangement of the flow channel, a wearable closing surface region having the requisite length, without requiring an unusually large plate. The square, hexagonal or round shapes of the end surface (through which no flow channels open) provide for a closing member design which is as compact as possible.

Furthermore, it is especially advantageous if the external surfaces having flow channel openings therethrough are essentially the same size and shape. With such an arrangement, it is not necessary to change the carrier frame upon turning and/or rotating the closing member to bring a new flow channel into an operative position.

In the case of a closing member having a square cross-section, the longitudinal axes of the flow channels are preferably orthogonal to each other, as are the external working surfaces of the two or three flow channels. If the closing member has a hexagonal cross-section, the flow channels are preferably arranged at 60° angles with respect to one another in order to distribute the wear and tear of the closing member as uniformly as possible.

Optimal use of the geometric ratio of the closing member can be achieved by having the respective flow channels formed through portions of the closing member such that they are spaced from one another along the longitudinal direction of the closing member and such that the wearable closing surface region assigned to each flow channel is longitudinally adjacent that flow channel. In other words, each of the external surfaces through which an opening is formed by an end of one of the flow channels has a closing region thereon which has no opening formed therethrough and which is formed on a portion of its respective external surface which is adjacent a portion of an adjacent external surface through which an opening is formed by an end of another one of the flow channels. In this manner, if the closing member is made, for example, of a single piece of a ceramic material, the functionability will not be impaired by cracks formed in the vicinity of the already used flow channel.

However, it is also possible to have the flow channels intersect and cross one another with the non-used channel sections being sealed with dummy plugs made, for example, of high-grade refractory material such as oxide. With this arrangement, unused flow channels can be put into use by rotating the closing member about only one axis rather than about two axes.

In order to improve the structural stability of the closing member, rod-shaped metal reinforcement members can be connected with or embedded in the closing member. The reinforcement members may also serve as elements for rotatably mounting the closing member in the carrier frame.

In a preferred embodiment, the closing member is formed as a one-piece block made of ceramic or other refractory material.

In order to make it unnecessary to form the closing member of a high-grade refractory material and/or to make necessary replacement of the closing member less frequent, the external working surfaces can be defined by refractory plates and/or the flow channels can be defined by refractory sleeves as well as openings through the refractory plates. The refractory sleeves and plates are preferably ceramic and should be readily attachable to and detachable from the closing member. For example, the refractory plates may be detachably mounted in recesses formed through the external surfaces of the closing member.

It is also possible to design the closing member as a metal cage with refractory plates and/or refractory sleeves. In such a closing member, the cage has recesses for the selected receipt of such refractory plates and/or refractory sleeves, and can carry out the functions of a closing member for a slide gate. The refractory sleeves may, for example, be connected to and extend from the refractory plates.

The closing member can be designed to be permanently mounted in a metal frame so that the closing member and frame must be replaced at the same time.

The closing member of the invention can be compression molded and fired in a conventional manner from a ceramic refractory material, or can be compression molded and/or poured from refractory concrete. In a preferred embodiment, all of the flow channels are essentially the same length. Therefore, the closing member of the invention is, for example, about twice as thick or high as is a conventional slide gate closing member. This has the advantage that the risk of closing members of the invention being damaged by cracks being formed therein is significantly reduced relative to conventional slide gate closing members.

The closing member of the invention can be used for linear as well as rotary or swivel slide gates. The closing member can be totally or partially permeable in order to facilitate the flushing of gas through the closing member in order to prevent freezing or build up of deposits and for sealing against the outer atmosphere.

Furthermore, the invention relates to a slide gate, for a molten metal container, which has a closing member as explained in detail above. Its special feature is that the closing member can not only be moved longitudinally but can also be rotated. In this manner the different flow channels can be readily brought into their respective working positions.

The closing member can also be arranged so that it can be adjusted in the longitudinal as well as the lateral direction so that the slide gate can be opened and closed by adjusting the closing member in different directions. In this manner, the service life of the closing member can be extended further because, during the controlling and/or closing process, different wearable edges of the flow channels are exposed to the molten metal stream.

In order to mount the closing member in a metal carrier frame, the closing member is preferably formed with recesses in its end surfaces and the carrier frame is formed with pins mounted thereto and adapted to be received in the recesses formed in the closing member end surfaces, or the closing member is formed with pins extending from its end surfaces and recesses are formed in the carrier frame and are adapted to receive the pins extending from end surfaces of the closing member. Each time the closing member is rotated to switch flow channels, such mountings will have to reseat themselves to adapt to the thrust of the molten metal flow being against a different portion of the closing member.

The closing member can be mounted in a releasable housing so that it can be readily rotated to switch flow channels.

Support springs can also be provided to bias the closing member upwardly against a bottom plate of the molten metal container in order to assure the sealing of the slide gate. This can be accomplished, for example by a simple construction in which the pins of the closing member or its cage are mounted in bearing parts which are biased upwardly by the support springs mounted, for example, between the carrier frame and the bearing parts.

In order to provide for rapid replacement, the bottom plate can also be mounted in a releasable frame.

Other goals, features, advantages and applications of the present invention will become apparent from the following description of the invention with the aid of the drawings. In this case, all described and/or illustrated features form in themselves, or in any logical combination, the object of the present invention.

DETAILED DESCRIPTION OF THE INVENTION

Figure 1:
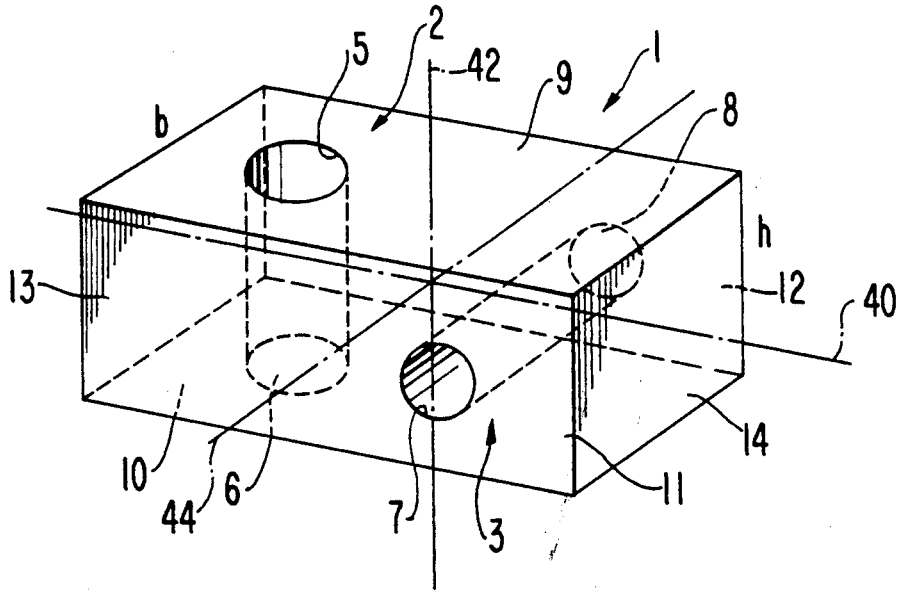
FIG. 1 is a perspective view of a block-shaped closing member according to the invention.

The closing member 1 of FIG. 1 is a one piece refractory ceramic block, which provides the functions of a conventional closing member, in particular a slidable or movable plate member, when incorporated in a slide gate for a molten metal container. The block-shaped closing member 1 has two opposed parallel external working surfaces 9 and 10 as well as parallel external working surfaces 11 and 12 disposed perpendicular to surfaces 9 and 10. The surfaces 9 to 12 are all of the same size and shape. Thus, the closing member 1 has equal height h and width b dimensions such that end surfaces 13 and 14 of the closing member 1 are square (and the closing member has a square cross-section). The closing member 1 has two longitudinally spaced apart flow channels 2 and 3 formed therethrough. The axes of the two flow channels 2, 3 are perpendicular to the longitudinal axis 40 of the closing member 1 and are orthogonal to one another. The opposing ends of the flow channels form openings 5, 6, 7 and 8 through the surfaces 9, 10, 11 and 12, respectively. At least one of the external surfaces through which each of the flow channels opens is utilized as a working surface. The arrangement of the flow channels 2, 3 in the closing member 1 is such that by rotating the closing member 1 by 90° around its longitudinal axis 40 and turning the closing member 1 by 180° around one of center axes 42 and 44, the flow channel 3 is moved to the location previously occupied by flow channel 2. It follows from this arrangement of the flow channels 2, 3 that the openings 5, 6 are formed in external surfaces 9, 10 that are bordered by the external surfaces 11, 12 through which the openings 7, 8 are formed.

Figure 2:
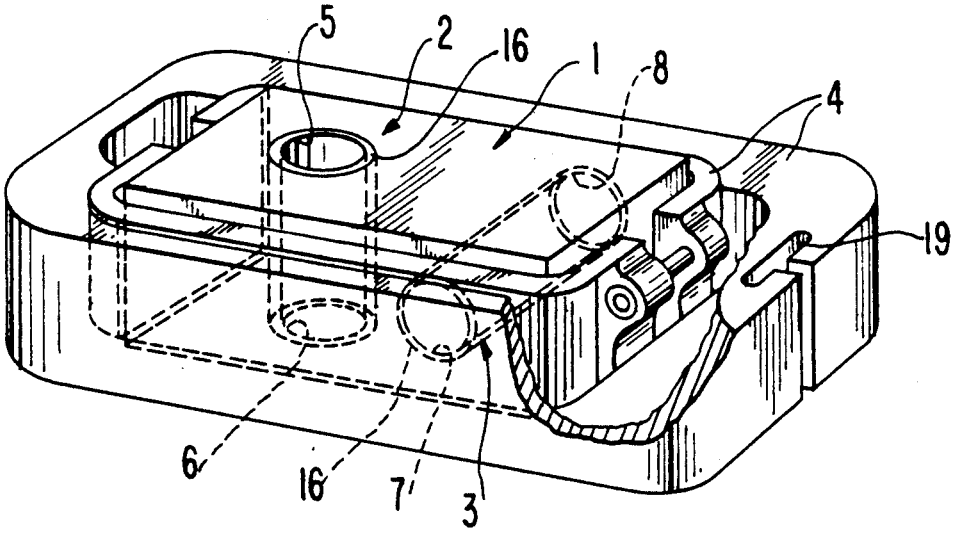
FIG. 2 is a perspective view of the closing member of FIG. 1 inserted into a carrier frame of a slide valve.

According to FIG. 2, such a closing member 1 is inserted into a carrier frame 4, which, in the case illustrated, comprises an inner frame holding device and an outer carrier frame piece. The latter has a recess in which the closing member 1 and the frame holding device can be inserted. The carrier frame and thus the closing member can be biased against a bottom or stationary plate 24 by support springs (not shown). The carrier frame piece also has an engaging opening 19 through which a slide gate drive 27 extends (FIG. 3).

FIG. 2 also shows that the flow channels 2 and 3 can be lined with wear resistant refractory sleeve 16 which are preferably formed of ceramic. By using sleeves 16 formed of relatively high-grade material the closing member 1 itself can be made of a lower quality material, for example, a refractory concrete.

Figure 3:
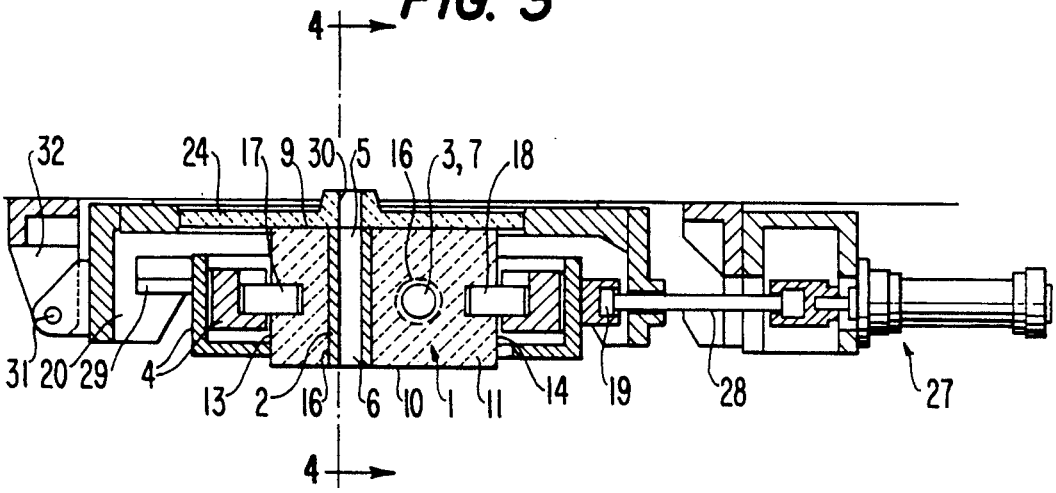
FIG. 3 is a vertical longitudinal sectional view of a slide gate according to the invention.
Figure 4:
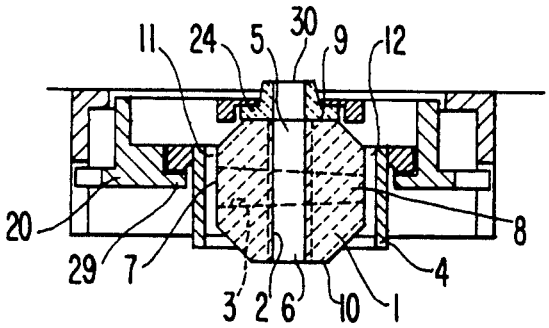
FIG. 4 is a sectional view taken along line 4—4 of the slide gate illustrated in FIG. 3.

The closing member 1 of the slide gate, illustrated in FIGS. 3 and 4, carries out the functions of a slidable or movable plate member in a conventional slide gate. As illustrated in the sectional view of FIG. 4, the closing member 1 need not be purely block-shaped, but rather may be bevelled along its longitudinal edges (i.e. along corners formed between adjacent external surfaces). In each of its end surfaces 13 and 14, the closing member 1 has a recess 17 formed for receipt of pins 18 which can also be rotatably mounted within recesses or bearing portions of the carrier frame 4. The unit made up of carrier frame 4 and closing member 1 can be moved linearly along slide rails 29 with respect to the bottom plate 24 by means of the slide gate drive 27, which includes an actuating rod 28 which extends into the engaging opening 19 of the carrier frame 4. The unit can be moved by slide gate drive 27 in such a manner that not only the flow channel 2 but also, after rotating the closing member 1 around its longitudinal axis 40 (i.e. about the rotational axis for pins 18), the flow channels 3 can be placed in operative position below the flow opening 30 of the bottom plate 24. With this arrangement, there is no need for a second rotation of the closing member 1. The slide rails 29 are components of a housing 20. The housing 20 is pivotally mounted about an axis 31 to a mounting element 32 fixed relative to the molten metal container.

After the housing 20, to which is mounted the carrier frame 4 and the closing member 1, has been released (i.e. pivoted about pin 31 away from the molten metal container), the closing member 1 can be readily removed from the carrier frame 4. The bottom plate 24 is also readily accessible for a quick replacement.

Figure 5:
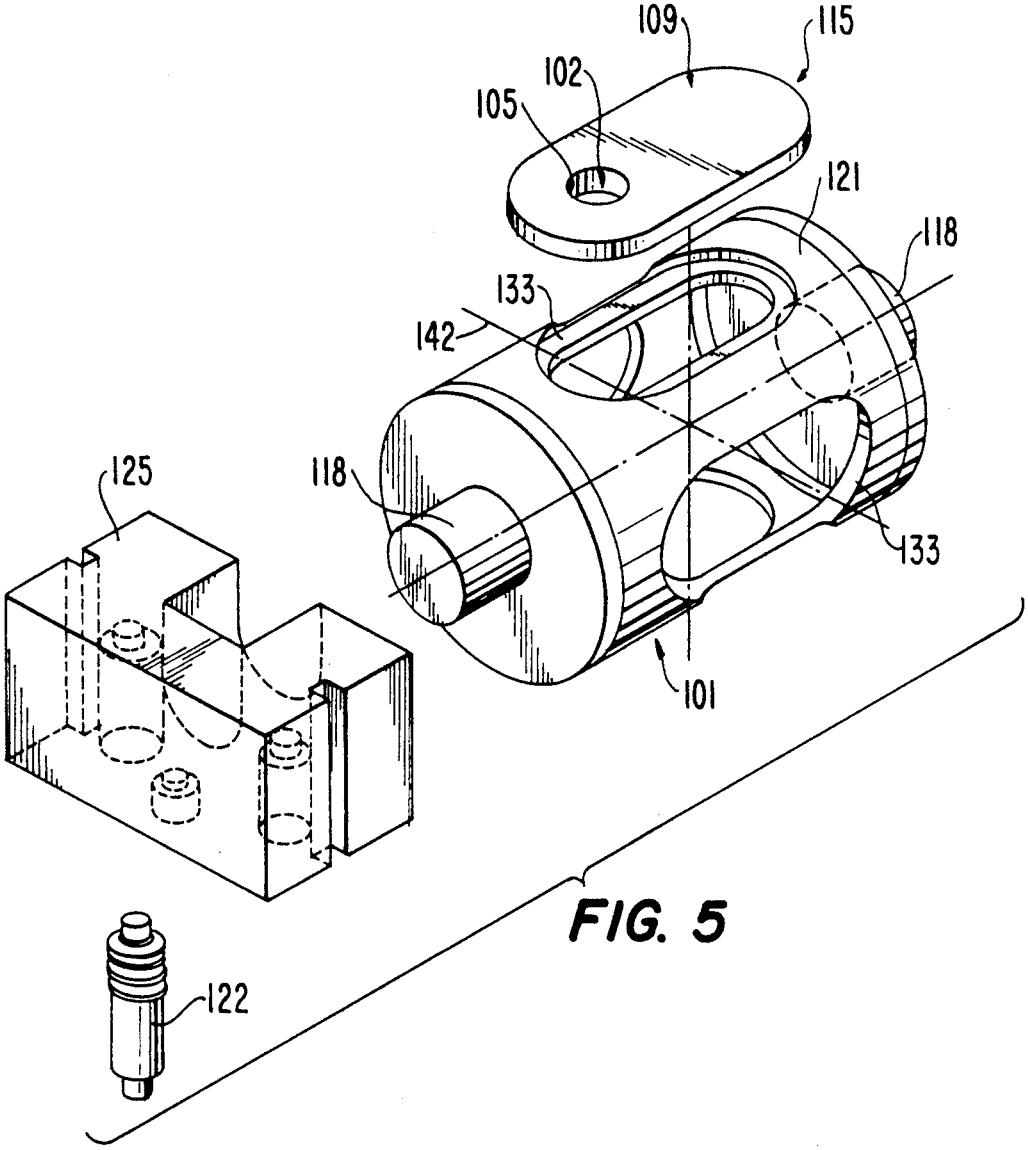
FIG. 5 is an exploded perspective view of a closing member according to another embodiment of the invention.
Figure 6:
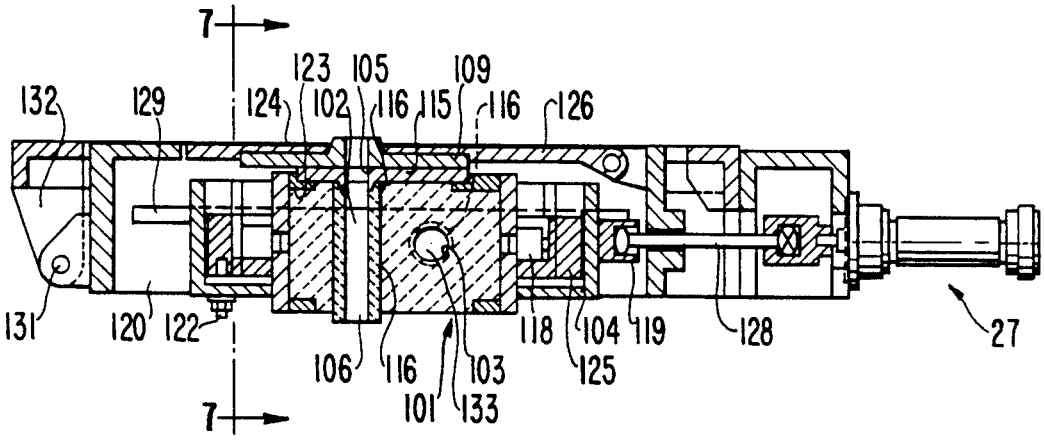
FIG. 6 is a longitudinal sectional view of a slide gate utilizing the closing member of FIG. 5.
Figure 7:
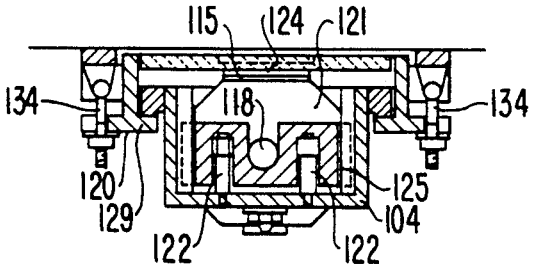
FIG. 7 is a sectional view taken along line 7—7 of the slide gate illustrated in FIG. 6.

In an alternate embodiment of the invention illustrated in FIGS. 5–7, the closing member 101 comprises an essentially cylindrical cage 121. The shell of the cage 121 has a number of recesses 133 formed through the exterior surface thereof. In the illustrated case, there are four recesses 133 formed through the shell of the cage 121. A refractory plate 115 is inserted into at least one of the recesses 133, the refractory plate 115 having an opening 105 therein which forms an end of a flow channel 102. The refractory plate 115 also has a surface 109 which acts as a working surface at an external surface of the closing member. The cage 121 has end surfaces to which pins 118 are mounted in order to rotatably mount the cage 121 into bearing elements 125, which are biased toward bottom plate 124 by means of supporting springs 122, as shown in FIGS. 6 and 7, mounted between a carrier frame 104 and the bearing elements 125. It is also clear from FIG. 6 that the refractory plate 115 made of a refractory material can be combined with a refractory sleeve 116. This results in an opening 106 in the recess 133 on the opposite side of central longitudinal axis 140 from the refractory plate 115. The refractory plate 115 and the refractory sleeve 116 can also be designed as a single piece. An additional flow channel 103 can be formed by a second refractory plate 115 and a second refractory sleeve 116 being mounted in one of the recesses 113 adjacent the recess 133 in which the first mentioned refractory plate is mounted. As shown in FIG. 6, the result is a combination of flow channels 102 and 103 that are orthogonal to one another in a manner similar to flow channels 2 and 3 in the embodiment of FIG. 3. However, the embodiment of FIGS. 6 and 7 has the advantage that the cage 121 can be reused multiple times with only the refractory plates 115 and the refractory sleeves 116 having to be replaced often because of wear. With the aid of springs 122, the external working surface 109 of the refractory plate 115 is forced against the bottom working surface of the bottom plate 124, which in FIG. 6 is mounted in frame 126 at the bottom of the molten metal container such that it can be removed from below. The cage 121, designed as a hollow cylindrical rotary member, can, among other things, also be lined with a refractory insulating material in order to further protect the refractory plate 115 and the refractory sleeve 116. FIG. 6 also illustrates that a housing 120 of the slide valve can be pivotally mounted about an axis 131 to a mounting 132 on the molten metal container. The housing 120 is fastened at its end opposite the axis 131 under the bias force of the support springs 122 to the bottom of the molten metal container by way of adjustable screws 134. In the embodiment of FIGS. 6 and 7, as in the embodiment of FIG. 3, the slide gate formed by the carrier frame 104 and the closing member 101 is arranged in such a manner that not only the flow channel 102 but also the flow channel 103 can be selectively moved into working position by a slide gate drive 27 having an actuating rod 128.

I claim:

1. A slide gate for a molten metal container, comprising a housing;

a carrier frame mounted in said housing;

a closing member mounted in said carrier frame and having a plurality of external surfaces, a first flow channel formed through said closing member and having opposite ends forming openings through different ones of said plurality of external surfaces, and a second flow channel formed through said closing member and having opposite ends forming openings through different ones of said plurality of external surfaces, said external surfaces through which said ends of said second flow channel form openings being different external surfaces than said external surfaces through which said ends of said first flow channel form openings, said first and second flow channels being adapted to allow fluid through said closing member; and moving means for moving said carrier frame and said closing member relative to said housing.

2. A slide gate as recited in claim 1, wherein said moving means includes means for rotatably mounting said closing member in said carrier frame.

3. A slide gate as recited in claim 1, wherein said closing member has a central longitudinal axis extending parallel to each of said external surfaces; and said means for moving includes means for moving said closing member laterally with respect to said longitudinal axis and relative to said housing.

4. A slide gate as recited in claim 1, wherein said closing member has two end surfaces with pins extending respectively outwardly therefrom; and means are provided on said carrier frame for receiving said pins to thereby mount said closing member in said carrier frame.

5. A slide gate as recited in claim 1, wherein said carrier frame has opposite ends with pins extending respectively inwardly therefrom; and means are provided on said closing member for receiving said pins to thereby mount said closing member in said carrier frame.

6. A slide gate as recited in claim 1, further comprising means for pivotally mounting said housing relative to the molten metal container.

7. A slide gate as recited in claim 1, wherein said moving means comprises means for slidably mounting said carrier frame to said housing.

8. A slide gate as recited in claim 7, wherein said moving means further comprises means for driving said carrier frame to slide relative to said housing.

9. A slide gate as recited in claim 1, further comprising a releasable frame member; and means for pivotally mounting said releasable frame member to said housing.

10. A slide gate as recited in claim 9, further comprising a bottom plate releasably mounted to said releasable frame member; and means for biasing said closing member against said bottom plate.

11. A slide gate for a molten metal container, comprising:

a closing member including a hollow cage having a central longitudinal axis, an exterior surface and at least four recesses formed through said exterior surface, at least four of said recesses being formed in respectively different planes spaced about said longitudinal axis, each of said different planes being disposed parallel to and on an opposite side of said longitudinal axis from another of said different planes;

at least one refractory plate having an opening therethrough and being respectively mounted in at least one of said recesses; and at least one refractory sleeve respectively mounted within said cage in alignment with said opening and substantially perpendicularly to the plane within which the recess, having said refractory plate mounted therein, is formed, at least one of said opening and said refractory sleeve defining a flow channel which is adapted to allow fluid to flow through said closing member.

12. A slide gate as recited in claim 11, wherein said at least one refractory plate comprises two refractory plates, each having an opening therethrough and being respectively mounted in two of said recesses; and said at least one refractory sleeve comprising two refractory sleeves respectively mounted within said cage in alignment with said openings and substantially perpendicularly to the planes within which the recesses, having said refractory plates mounted therein, are formed, first and second flow channels being at least partially defined by said two refractory sleeves and being adapted to allow fluid flow through said closing member.

13. A slide gate as recited in claim 12, wherein said first and second flow channels are substantially orthogonal to one another.

14. A slide gate as recited in claim 13, wherein said first and second flow channels are spaced from one another in the direction along said central longitudinal axis.

15. A slide gate as recited in claim 12, wherein said closing member further includes two additional refractory plates mounted in the respective ones of said recesses which are in planes parallel to and on opposite sides of said longitudinal axis from the planes within which said recesses, which have said two refractory plates mounted therein, are formed, each of said additional refractory plates having an opening formed therein in alignment with the one of said refractory sleeves which is respectively perpendicular to that additional refractory plate.

16. An apparatus as recited in claim 12, wherein said closing member has a second central axis which is parallel to one of said first and second flow channels; and said first and second flow channels are arranged such that if said closing member is rotated 90° about said central longitudinal axis and 180° about said second central axis, one of said first and second flow channels will assume a position previously occupied by the other of said first and second flow channels.

17. A slide gate as recited in claim 11, wherein said closing member is substantially cylindrical.

18. A slide gate as recited in claim 11, wherein said closing member further includes insulating material disposed within said cage.

19. A slide gate as recited in claim 11, further comprising a carrier frame; and means for mounting said closing member in said carrier frame.

20. An apparatus as recited in claim 19, wherein said mounting means comprises means for mounting said closing member for rotation about said central longitudinal axis of said hollow cage.

21. An apparatus as recited in claim 19, wherein two end surfaces are formed respectively at opposite ends of said cage; and said mounting means comprises pins extending respectively outwardly from said end surfaces and means on said carrier frame for receiving said pins.

22. An apparatus as recited in claim 11, wherein said at least one refractory plate has a closing region thereon, longitudinally adjacent said opening, through which no openings are formed, said closing region providing a means to prevent fluid flow through said closing member.

* * * * *